United States Patent [19]

Creaser, Jr.

[11] Patent Number: 4,745,412

[45] Date of Patent: May 17, 1988

[54] LIGHTWEIGHT TOWER ASSEMBLIES FOR ANTENNAS AND THE LIKE

[75] Inventor: Charles W. Creaser, Jr., Hollis, N.H.

[73] Assignee: Chu Associates, Inc., Littleton, Mass.

[21] Appl. No.: 732,844

[22] Filed: May 10, 1985

[51] Int. Cl.[4] ..... H01Q 1/12

[52] U.S. Cl. ..... 343/890; 52/40; 52/638; 52/648; 343/891; 343/905

[58] Field of Search ..... 333/248, 254; 343/874, 343/875, 884, 905, 890–892; 52/40, 110, 648, 720, 733, 738, 637, 638; 174/40 CC

[56] References Cited

U.S. PATENT DOCUMENTS

| | | | |
|---|---|---|---|
| 1,676,161 | 7/1928 | Schiller et al. | 52/40 |
| 2,282,221 | 5/1942 | Gibbons | 52/648 |
| 2,945,231 | 7/1960 | Scheldorf | 343/891 X |
| 2,982,572 | 5/1962 | Farber | 52/648 X |
| 3,318,561 | 5/1967 | Finke et al. | 343/890 |
| 4,122,646 | 10/1978 | Sapp | 52/648 |
| 4,541,509 | 9/1985 | D'Alessio et al. | 52/637 X |

FOREIGN PATENT DOCUMENTS

| | | | |
|---|---|---|---|
| 2009252 | 9/1971 | Fed. Rep. of Germany | 52/638 |
| 2658199 | 7/1978 | Fed. Rep. of Germany | 343/875 |

OTHER PUBLICATIONS

Catalog of Microwave Towers by *Tower Construction Company*; Sioux City, Iowa, made available Dec. 22, 1959; see pp. 18, 19.

*Primary Examiner*—Eugene R. LaRoche
*Assistant Examiner*—Benny Lee
*Attorney, Agent, or Firm*—Rines and Rines, Shapiro and Shapiro

[57] ABSTRACT

A lightweight extruded aluminum tube and longitudinal fin structure and assembly enabling the use of two or three pluralities of identical parts only for ready hand-carrying and erection.

4 Claims, 1 Drawing Sheet

LIGHTWEIGHT TOWER ASSEMBLIES FOR ANTENNAS AND THE LIKE

BACKGROUND OF THE INVENTION

The present invention relates to tower assemblies for antennas and the like, being more particularly directed to lightweight towers that, in some instances, may be hand-carried and erected in a portable manner.

The art is replete with a myriad of tower structures used through the years for mounting antennas and similar rigs, and requiring structural strength and resistance to the wind and other environmental factors. Tubular tower legs have been employed with welded and otherwise attached lugs or similar elements for attaching struts and other supporting elements, with inherent weak points at the welds succumbing to flexing, rusting and other wear factors, particularly as sections are pyramided one upon another to achieve the desired height, which also introduces stability problems and usually the need for extensive guy wiring. Numerous different parts, moreover, are customarily required for constructing the assembly, including some that are relatively heavy and sometimes costly and complex.

SUMMARY OF THE INVENTION

An object of the present invention, accordingly, is to provide a new and improved tower assembly for antennas and the like that overcomes the above and other disadvantages of prior structures and, to the contrary, enables the use of a minimum number of different parts (two or three types only, if desired) and also insures lightweight (even hand-portable) structures, through novel extruded design and assembly configurations.

A further object is to provide a novel tower assembly of more general utility, as well.

Other and further objects will be explained hereinafter and are more particularly delineated in the appended claims.

In summary, from one of its important aspects, the invention embraces a lightweight antenna tower structure assembly having, in combination, three substantially identical tubular legs each comprising a hollow extruded aluminum tube having integral pairs of radially extending fins subtending an angle ranging from substantially acute to an obtuse angle and extending longitudinally external to and along the outer surface of the tube parallel to the longitudinal axis thereof, with the tubes mounted at the vertices of an equilateral triangle and with the fins facing inwardly of the triangle; bolt-receiving apertures disposed at preselected intervals longitudinally along each of said fins; a plurality of substantially identical extruded aluminum struts each flattened at its ends and provided with bolt-receiving apertures therein; and means for bolting the flattened ends of each strut against and to corresponding fins of adjacent tubes through aligned apertures in the flattened ends and in the fins to provide a periodic structural connecting and ladder assembly. Preferred details and best mode embodiments are later described.

BRIEF DESCRIPTION OF THE DRAWINGS

The invention will now be explained with reference to the accompanying drawings, in which.

DESCRIPTION OF PREFERRED EMBODIMENT

Figure 1:
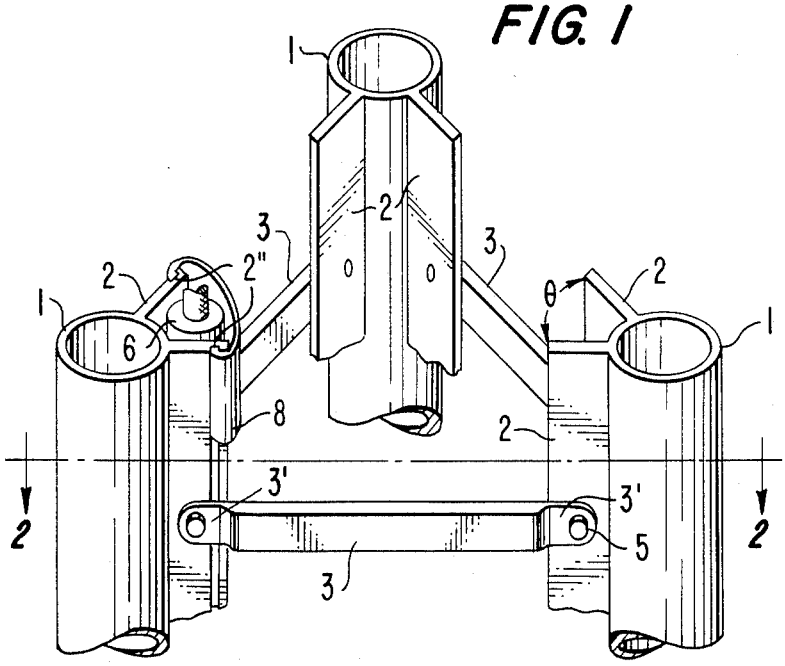
FIG. 1 is a fragmentary isometric view of the invention assembled in preferred form.

In accordance with the invention, as shown in FIG. 1 extruded aluminum or similar lightweight hollow tubing 1 is employed having integral extruded pairs of radially extending fins 2 subtending an angle ranging from substantially acute to an obtuse angle $\theta$ and extending longitudinally of and external to the outer surface of the tube, parallel to its longitudinal (vertical, as shown assembled) axis. The three tubes and fins 1-2 constitute a first plurality of identical parts serving as the legs of the tower and arranged at the vertices of an equilateral triangle (for structural strength) with the pairs of fins 2 facing inwardly of the triangle. The right-hand (lower) fin 2 of the left-most tubular leg 1, as shown in FIG. 1, and the left-hand (lower) fin 2 of the right most tubular leg 1, lie on the bottom side of the triangle; and the left-hand (upper) fin 2 of the uppermost leg 1 lie on the left-hand fin 2 of the uppermost leg 1 lie on the left-hand triangle side, with the right-hand fin 2 of the uppermost leg 1 and the right-hand (shown upper) fin 2 of the right-hand leg 1 defining the remaining triangle side. The legs 1 may comprise the bottom section of the tower, the lower ends of which are sunk into the ground, for example.

Figure 2:
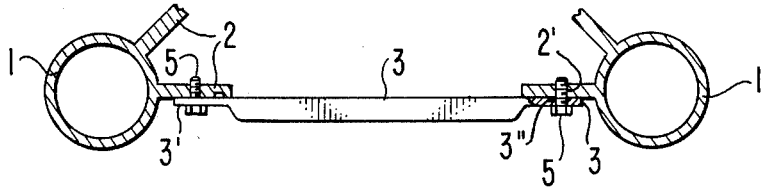
FIG. 2 is a transverse section along the line 2—2 of FIG. 1.

To assemble the legs into a strong structure, a second plurality of identical light-weight strut elements 3 is employed each being an aluminum or similar extruded bar flattened at its ends 3' so that the flattened ends may be assembled against the outer flat surfaces of the fins 2 as by bolts 5 passed through aligned apertures 3'' and 2', FIG. 2, formed in the flattened ends 3' and at periodic longitudinally spaced intervals along the fins 2, respectively. When attached horizontally at periodic intervals, as in FIG. 1, the supporting struts 3 can serve as a ladder for climbing the tower assembly, as well; and if further bracing is desired, may be oriented diagonally as at 30 in FIG. 3.

Figure 3:
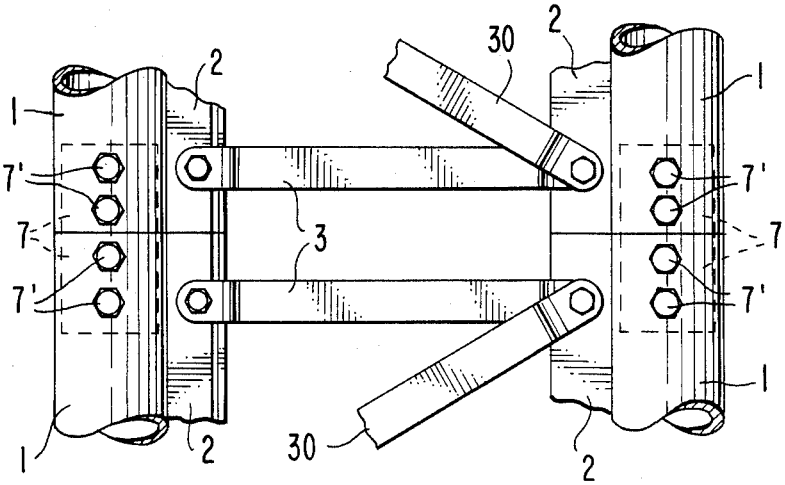
FIG. 3 is a side elevation of a modification illustrating two superposed tower sections.

The addition of further sections 1-2-3 may be readily effected with the aid of tubular or other inserts 7 bolted at 7' within the top ends of a lower set 1-2 and the bottom ends of an upper set 1-2 of FIG. 3 to secure the same together.

During the extrusion, longitudinal slot recesses 2'' may be provided inward of the free ends of the fins on their outer surfaces, to receive a thin clip 8 of resilient sheet material that may be clipped over the fins 2 (shown at the left-most tubular leg 1 in FIG. 1) subtending the angle and bounding the space therewithin to confine the coaxial cable or other transmission line 6 for the antenna (not shown) carried by the tower.

A successful tower of this type for communication type antennas has been constructed of 0.093 inch thick extruded aluminum tubing 1.25 inch in outer diameter and 10 ft. in length, with integrally extruded fins 0.155 inch thick and 1 inch in radially extending length, subtending an angle $\theta$ of 60 degrees. The clip 8 was resilient sheet brass.

Through the extruded design and construction of the invention, a minimum number of identical lightweight parts is required legs 1 (3 required): horizontal members 3, and diagonal struts 30, providing for ready hand-carrying and assembling operations and pyramiding of sets of sections for the desired tower height to top-mount the antenna or similar rig. It was found, moreover, that all of the parts for a ten foot tower may be packed in a cardboard or similar tube only $4\frac{1}{2}$ inches inner diameter and ten and a half feet long. A one-hundred foot tower constructed in accordance with the invention may be shipped in knocked-down form in a container 10 inches×25 inches×10 and one-half feet.

Further modifications will occur to those skilled in this art and such are considered to fall within the spirit and scope of the invention as defined in the appended claims.

What is claimed is:

1. A lightweight antenna tower structure having, in combination, three substantially identical tubular legs, each leg comprising a hollow, extruded, elongated tube having an integral pair of radially extending fins subtending an angle therebetween in planes perpendicular to the length of the tube and extending longitudinally external to and along the outer surface of the tube parallel to and substantially coextensive with the length thereof, the tubes being mounted at the vertices of an equilateral triangle configuration, at least one of said pairs of fins being provided with means for mounting a clip therebetween and subtending the angle thereof to confine a cable for the antenna; a plurality of substantially identical extruded struts each integrally flattened at its ends; and means for securing the flattened ends of each strut to respective fins of adjacent tubes between which the strut extends, the struts being disposed along corresponding sides of said triangle configuration and at periodic longitudinal intervals of the tower structure to provide a periodic connecting structure.

2. A lightweight antenna tower structure having, in combination, three substantially identical tubular legs, each leg comprising a hollow, extruded, elongated aluminum tube having an integral pair of radially extending fins subtending an angle therebetween in planes perpendicular to the length of the tube and extending longitudinally external to and along the outer surface of the tube parallel to and substantially coextensive with the length thereof, the tubes being mounted at the vertices of an equilateral triangle configuration and arranged with each fin aligned along a respective side of the triangle configuration, at least one of said pairs of fins being provided with recesses receiving a clip subtending the angle thereof, to confine a cable for the antenna; bolt-receiving apertures disposed at preselected intervals longitudinally along each of said fins; a plurality of substantially identical extruded aluminum struts each integrally flattened at its ends and provided with bolt-receiving apertures therein; and means for bolting the flattened ends of each strut against and to corresponding fins of adjacent tubes through aligned apertures in the flattened ends and in the fins to provide a periodic connecting and ladder structure.

3. A lightweight antenna tower structure as claimed in claim 1 and in which certain of said struts are oriented horizontally and others, are inclined.

4. A lightweight antenna tower structure as claimed in claim 1 and in which a second identical plurality of tubular legs and plurality of struts is assembled on top of the first-named legs, with internal connecting means secured within the top ends of the first-named legs and the bottom ends of the second legs to secure the same together.

* * * * *